US008546709B2

(12) United States Patent
Yeh

(10) Patent No.: US 8,546,709 B2
(45) Date of Patent: Oct. 1, 2013

(54) STRUCTURE FOR PREVENTING MISOPERATION OF FLASHLIGHT

(75) Inventor: Hsueh-Chu Yeh, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 220 days.

(21) Appl. No.: 13/158,496

(22) Filed: Jun. 13, 2011

(65) Prior Publication Data

US 2012/0312666 A1 Dec. 13, 2012

(51) Int. Cl.
*H01H 9/28* (2006.01)

(52) U.S. Cl.
USPC ..... 200/43.16

(58) Field of Classification Search
USPC ..... 200/43.16, 43.01, 43.11, 43.19, 43.21, 200/60, 241, 252, 318, 321, 318.1, 318.2, 200/327
See application file for complete search history.

(56) References Cited

U.S. PATENT DOCUMENTS 3,297,840 A * 1/1967 Gray et al. ..... 200/60
3,963,886 A * 6/1976 Yen ..... 200/60
4,429,202 A * 1/1984 Tedd et al. ..... 200/324
4,920,244 A * 4/1990 Gundlach ..... 200/321
5,434,378 A * 7/1995 McLean ..... 200/537
5,935,426 A * 8/1999 Giordano et al. ..... 210/87
6,118,088 A * 9/2000 Thielman ..... 200/43.16
6,467,930 B1 * 10/2002 Frick ..... 362/202

* cited by examiner

*Primary Examiner* — Edwin A. Leon
*Assistant Examiner* — Anthony R. Jimenez
(74) *Attorney, Agent, or Firm* — Alan Kamrath; Kamrath IP Lawfirm, P.A.

(57) ABSTRACT

A structure for preventing misoperation of a flashlight is configured to prevent a flashlight from being unintentionally turned on. The structure includes a safety pin and a slide power switch slidably provided on the flashlight. The slide power switch has a recess for removably receiving the safety pin. An embrasure-like channel is provided at a lower part of the safety pin for matching a T-shaped base in an accommodating area of the flashlight. A retaining portion is provided at the T-shaped base for retaining a bulge formed inside the channel of the safety pin when the structure is not in use. When the safety pin is pushed toward the slide power switch, the bulge climbs over the retainer and is then engaged with the recess of the slide power switch. Thereby, the flashlight not in use is secured from misoperation, namely being unintentionally turned on.

4 Claims, 9 Drawing Sheets

STRUCTURE FOR PREVENTING MISOPERATION OF FLASHLIGHT

BACKGROUND OF THE INVENTION

1. Technical Field

The present invention relates to a design of flashlight switches and more particularly, to a structure for preventing misoperation of a flashlight, with a safety pin provided at one side of the flashlight for illumination is operated to lock when the flashlight is not in use, to prevent a slide power switch of the flashlight from being unintentionally turned on.

2. Description of Related Art

Conventional flashlights for illumination can be divided into those using a push-button switch that turns on the flashlight in a first push and turns off the flashlight in a second push, and the others using a slide switch that turns on the flashlight when pushed in one direction and turns off the flashlight when pushed reversely. However, in either case, the switches are not designed with an operational limitation, and tend to be unintentionally turned on under a users' misoperation, in turn causing waste of power source in the flashlights.

SUMMARY OF THE INVENTION

The present invention therefore provides an improvement to conventional flashlights for illumination that are likely to have their power switches unintentionally turned on, by providing a slide power switch of a flashlight with a safety pin, so that the safety pin can lock the slide power switch when the flashlight is not in use, in turn preventing a users' misoperation that turns on the flashlight unintentionally.

A first objective of the present invention is to provide a structure for preventing misoperation of a flashlight being provided at one side of the flashlight and configured to prevent the flashlight from unintentionally turned on. The structure includes a safety pin located at an appropriate position with respect to a slide power switch. The slide power switch is slidably provided at a predetermined section of the flashlight at a periphery of the flashlight. The slide power switch has a recess for removably receiving the safety pin, an embrasure-like channel provided at a lower part of the safety pin for matching a T-shaped base in an accommodating area of the flashlight, and a retaining portion provided at a front part of the T-shaped base of the flashlight for retaining a bulge formed inside the channel of the safety pin when the structure is not in use. When the safety pin is pushed toward the slide power switch, the bulge climbs over the retainer and is then engaged with the recess of the slide power switch, whereby the flashlight not in use is secured from misoperation, namely being unintentionally turned on.

A second objective of the present invention is to provide the structure, with the slide power switch slidably provided on the flashlight having an inner surface thereof formed with an accommodating space for receiving a spring. One one end of the spring abuts against one side of a post provided on the flashlight. Thus, the slide power switch slidably provided on the flashlight is moved forward each time it is pushed, and then restored by a resilience of the spring.

A third objective of the present invention is to provide the structure, with the slide power switch slidably provided on the flashlight having an inner surface thereof formed with a pair of retaining portions at two axial edges for engaging with corresponding slots provided on the periphery of the flashlight, thereby allowing the slide power switch to slide in a predetermined range on the periphery of the flashlight.

A fourth objective of the present invention is to provide the structure, with the slide power switch slidably provided on the flashlight having an inner surface thereof formed with receiving hole for receiving a magnetic member, so that when the slide power switch is pushed forward, the magnetic member approaches a reed switch installed on the flashlight to activate the flashlight to illuminate or to turn off the flashlight.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein:

FIG. 7 is a top view showing the flashlight having an unlocked slide power switch of the present invention turned on;

DETAILED DESCRIPTION OF THE INVENTION

Figure 2:
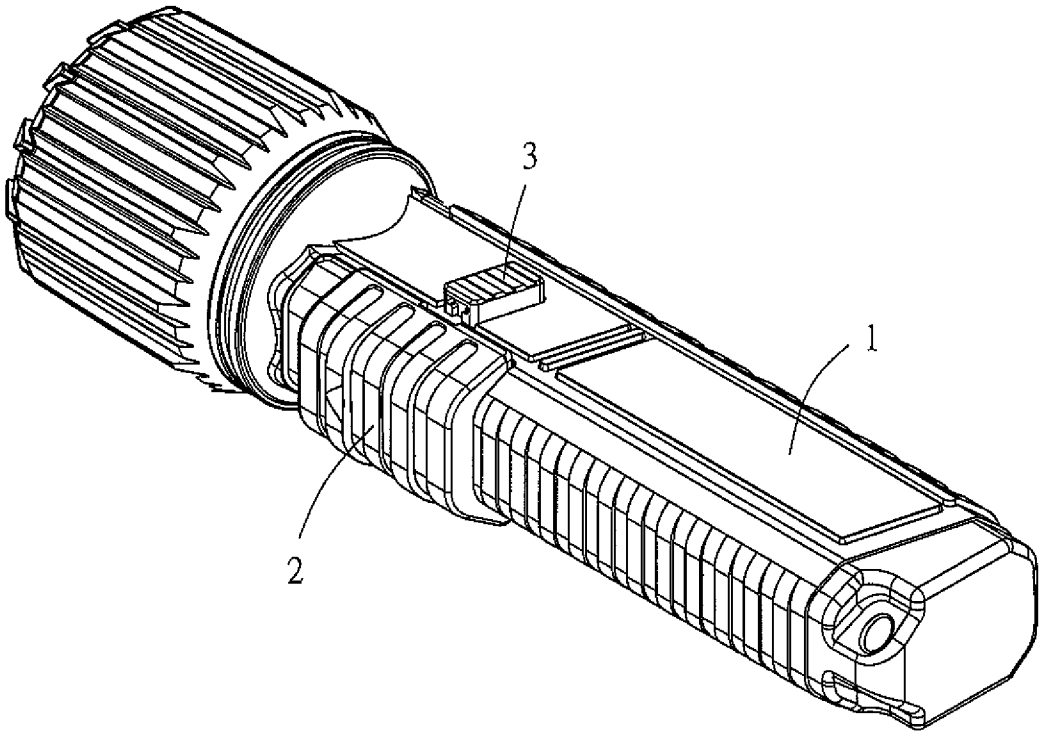
FIG. 2 is an assembled view of FIG. 1.

According to the present invention, a structure for preventing misoperation of a flashlight (as shown in FIG. 2) is provided at one side of the flashlight (1) for preventing the flashlight (1) from being unintentionally turned on, and comprises a safety pin (3) located appropriately with respect to a slide power switch (2) of the flashlight (1).

Figure 1:
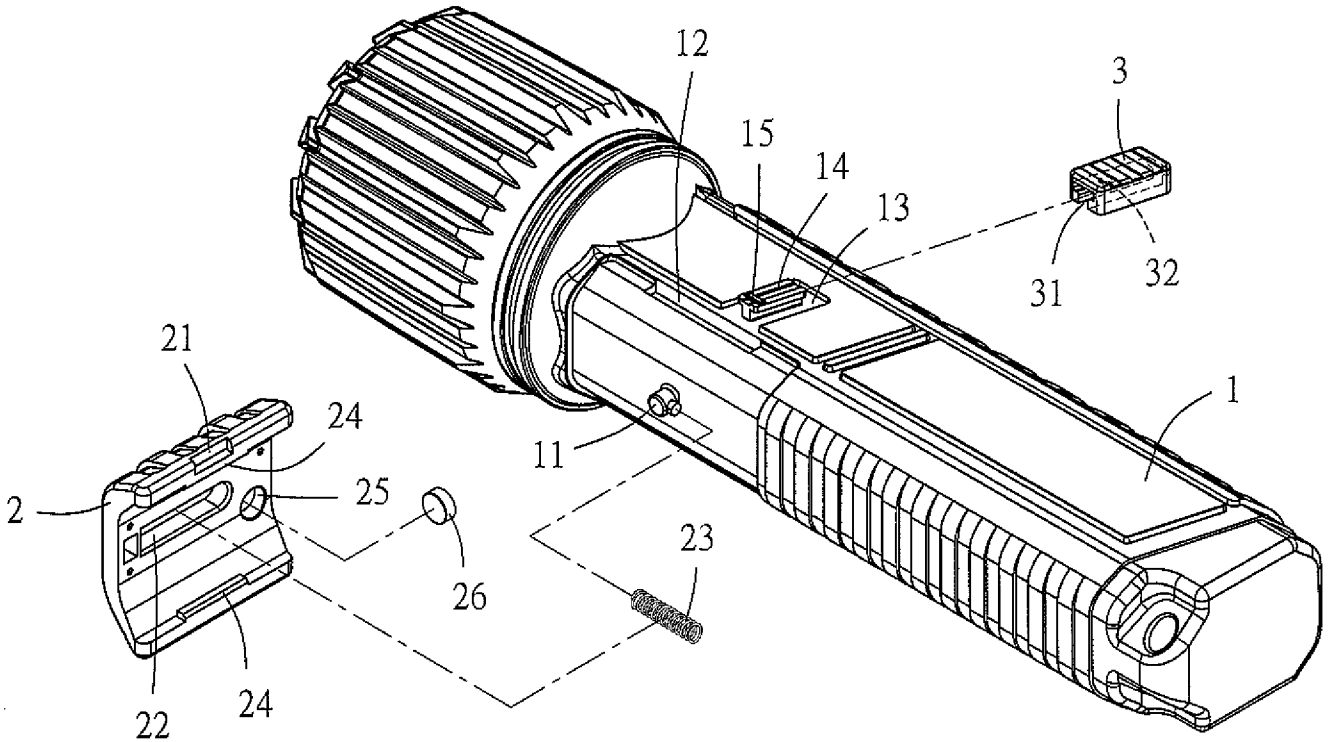
FIG. 1 is an exploded view of a structure for preventing misoperation on a flashlight according to the present invention.
Figure 3:
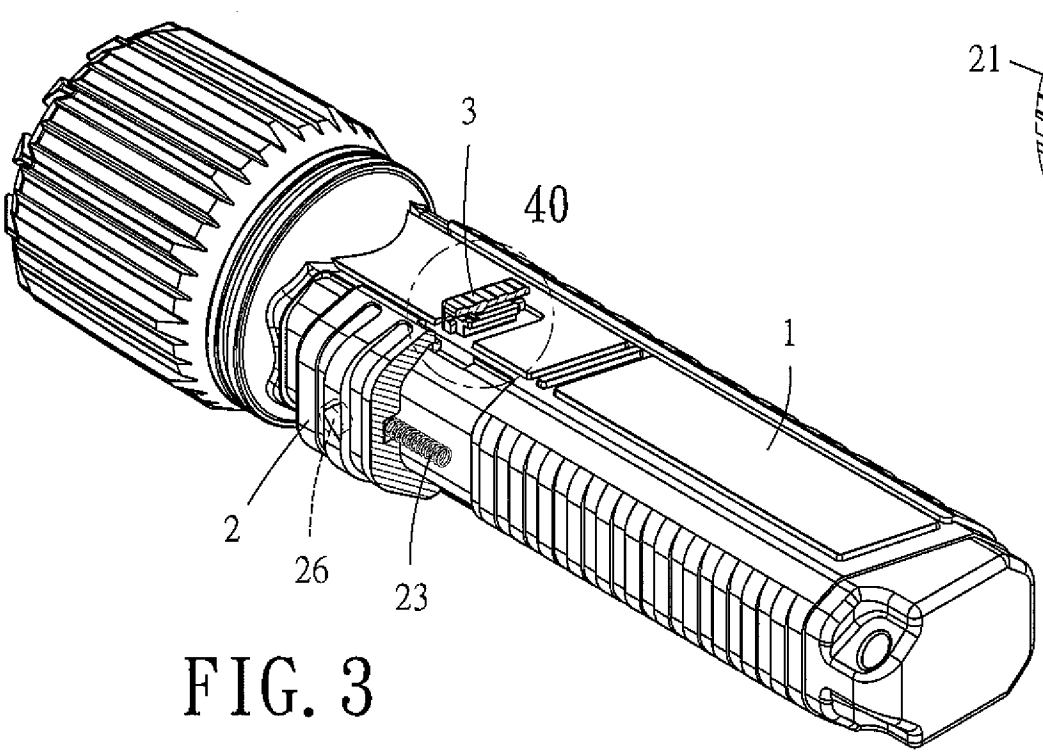
FIG. 3 is a perspective view showing the flashlight having a safety pin of the present invention at an unlocking position.
Figure 6:
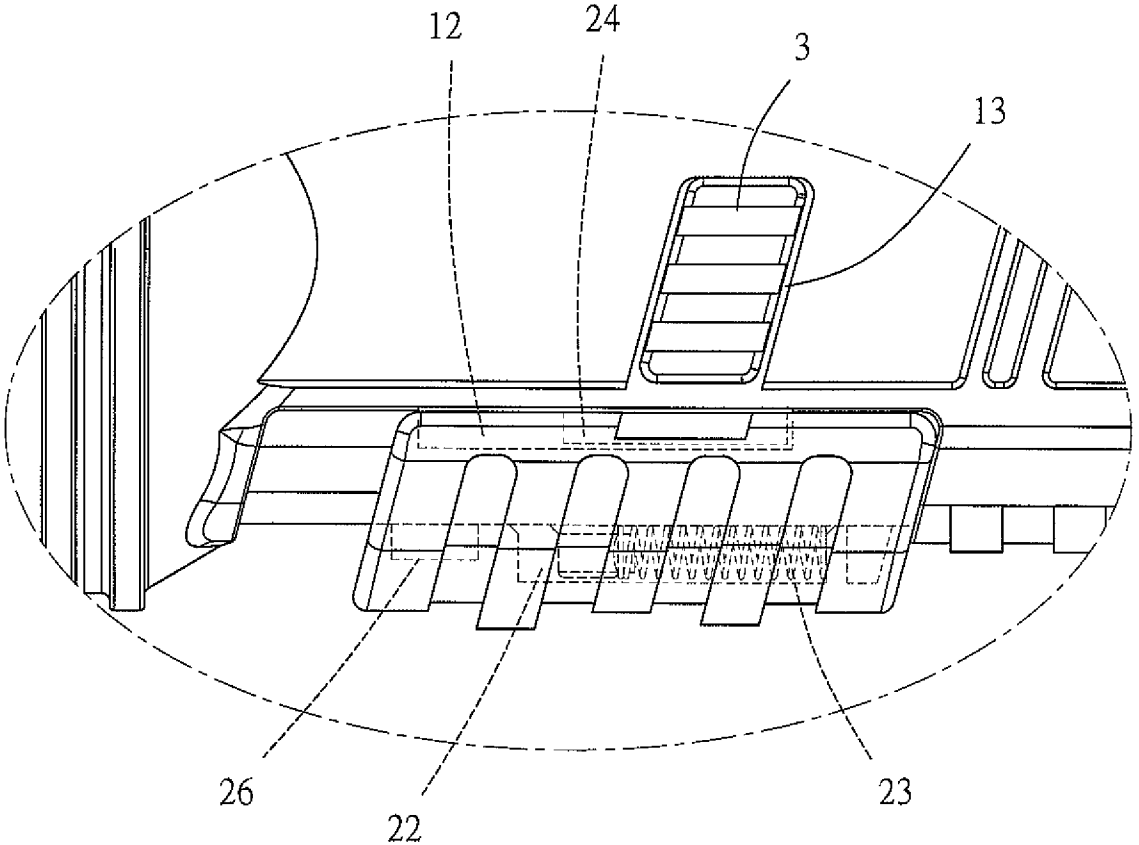
FIG. 6 is a partially enlarged view of Part 50 in FIG. 5.

The slide power switch (2) is operatably deposited at a periphery of a predetermined section of the flashlight (1) [as shown in FIG. 1]. The slide power switch (2) has a recess (21) depressed from its surface, and has an accommodating space (22) formed on its inner surface for such receiving a spring (23) therein [as shown in FIG. 3]. The spring (23) has one end abutting against a side of a post (11) provided on the flashlight (1) [as shown in FIG. 6]. Thereby, the slide power switch (2) at the periphery of the flashlight (1) can be manually pushed forward and be restored by the resilience of the spring (23). A pair of retaining portions (24) is provided on the inner surface of the slide power switch (2) at two axial edges for being engaged with two slots (12) correspondingly provided on the periphery of the flashlight (1) [as shown in FIGS. 3 and 6] and remaining vertically movable. A receiving hole (25) is formed at one end of the slide power switch (2) at the inner surface thereof for receiving the magnetic member (26) [as shown in FIGS. 3 and 6]. Thus, the slide power switch (2) pushed forward can interact with a reed switch [not shown] installed on the flashlight (1) to turn on or off the latter.

Figure 4:
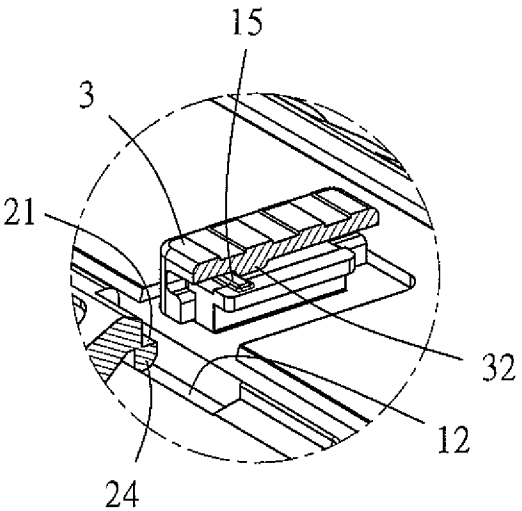
FIG. 4 is a partially enlarged view of Part 40 in FIG. 3.

The safety pin (3) has an embrasure-like channel (31) at a lower part thereof [as shown in FIG. 1], for being mounted on the T-shaped base (14) in the accommodating area (13) of the flashlight (1) [as shown in FIG. 3]. A retaining portion (15) is provided at a front part of the T-shaped base (14) of the flashlight (1), for retaining a bulge (32) formed inside the channel (31) of the safety pin (3) when the safety pin (3) does not work [as shown in FIG. 4].

Figure 5:
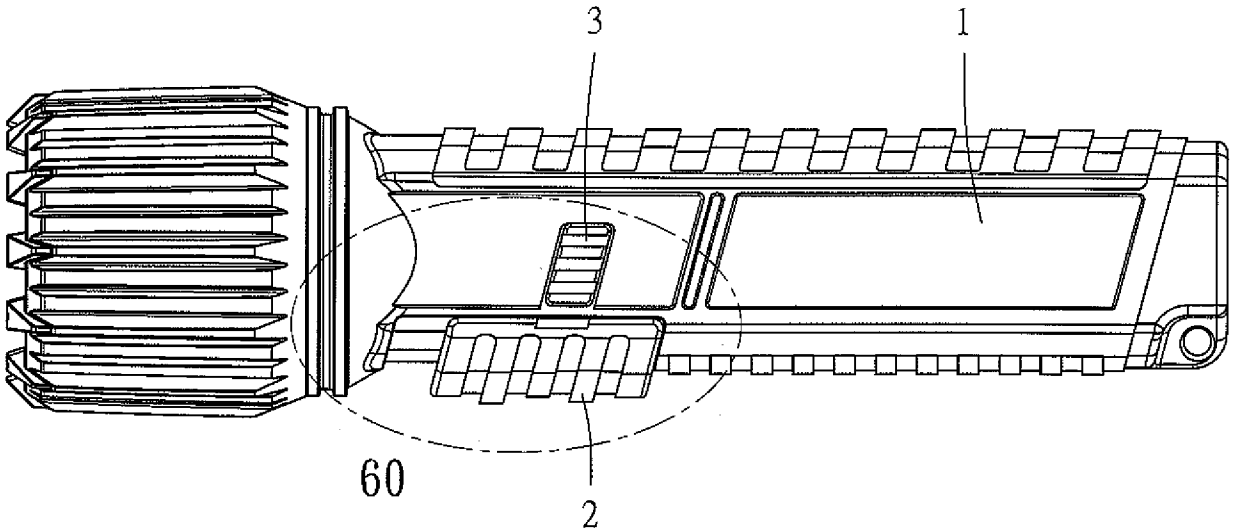
FIG. 5 is a top view showing the flashlight having the safety pin of the present invention at the unlocking position.
Figure 7:
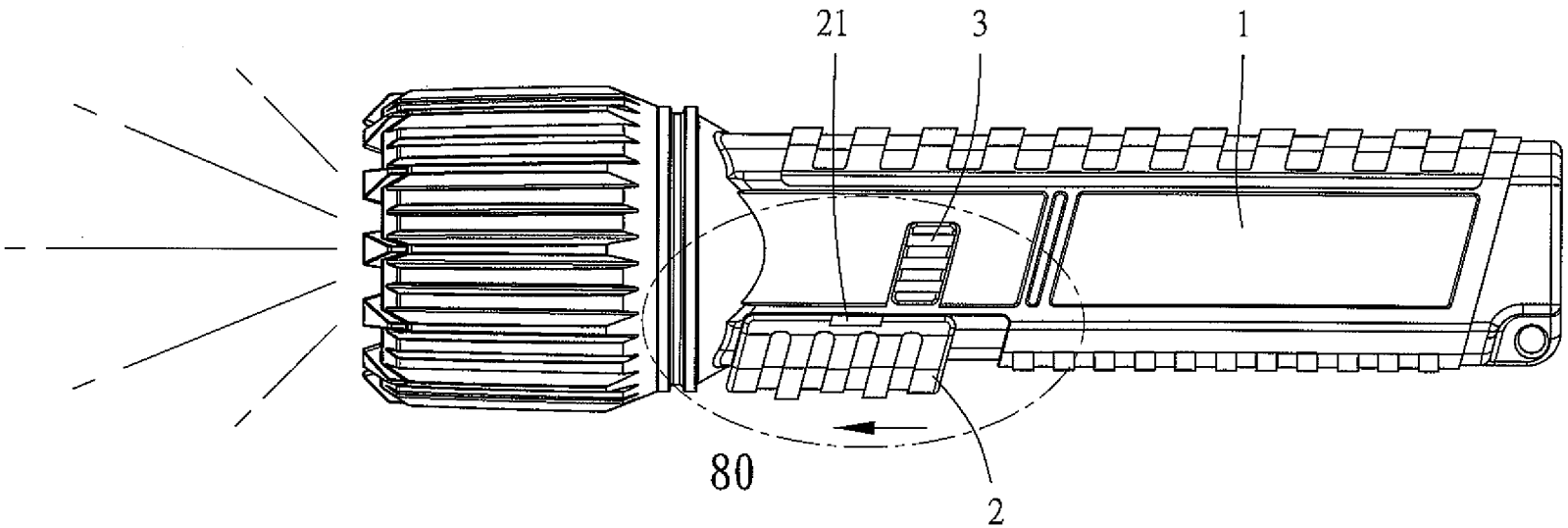
Figure 8:
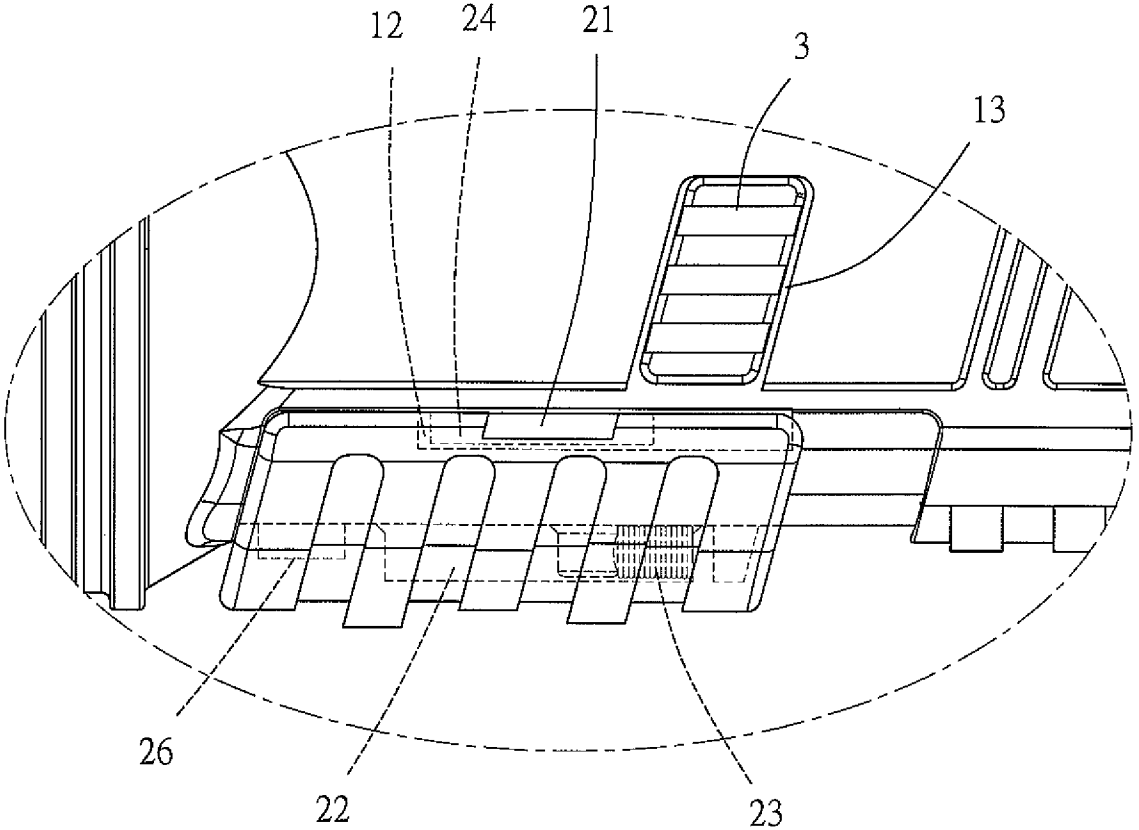
FIG. 8 is a partially enlarged view of Part 80 in FIG. 7.

In normal operation of the flashlight (1) [as shown in FIGS. 5 and 6], the slide power switch (2) at the periphery of the flashlight (1) and the safety pin (3) provided on the flashlight (1) [as shown in FIG. 2] are arranged such that the safety pin (3) is pulled backward to leave the slide power switch (2) free from its control, thereby allowing a user to push the slide power switch (2) at the periphery of the flashlight (1) forward when illumination is desired [as shown in FIGS. 7 and 8]. Upon this action, the magnetic member (26) is moved to turn on the reed switch at the front part of the flashlight (1), thereby establishing electric conduction and providing the desired illumination. Afterward, the slide power switch (2) is restored by the resilience of the spring (23) [as shown in FIGS. 5 and 6].

The flashlight (1) may be designed to provide multistage illumination, such as dimmed lighting, full lighting, flash lighting and light off. In this case, the first pushing forward activates dimmed lighting, the second pushing forward activates full lighting, the third pushing forward activates flash lighting, and the fourth pushing forward turns off the light source, such being a cycle. At each time the slide power switch (2) is pushed, the magnetic member (26) therein approaches the reed switch in the front part of the flashlight (1) to activate the illumination as the predetermined mode in the cycle, and then is restored by the resilience of the spring (23).

Figure 10:
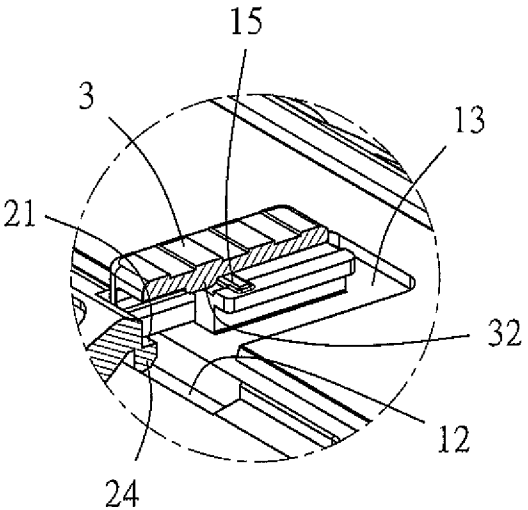
FIG. 10 is a partially enlarged view of Part 100 in FIG. 9.
Figure 9:
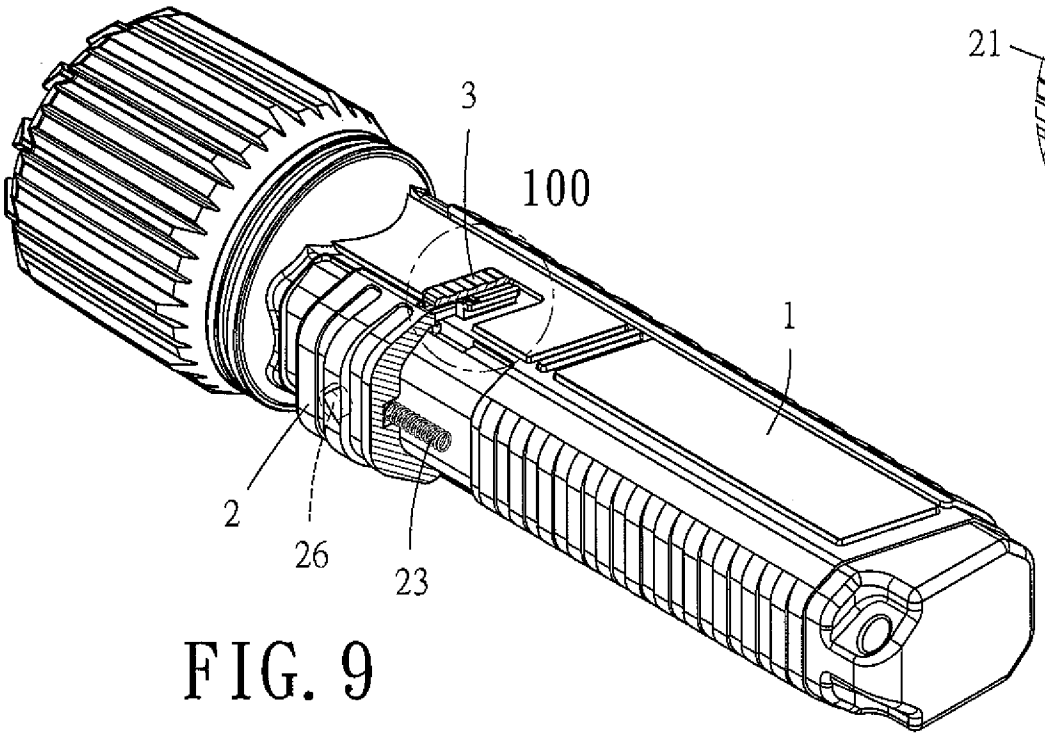
FIG. 9 is a schematic drawing showing the flashlight having the safety pin of the present invention at its locking position.
Figure 11:
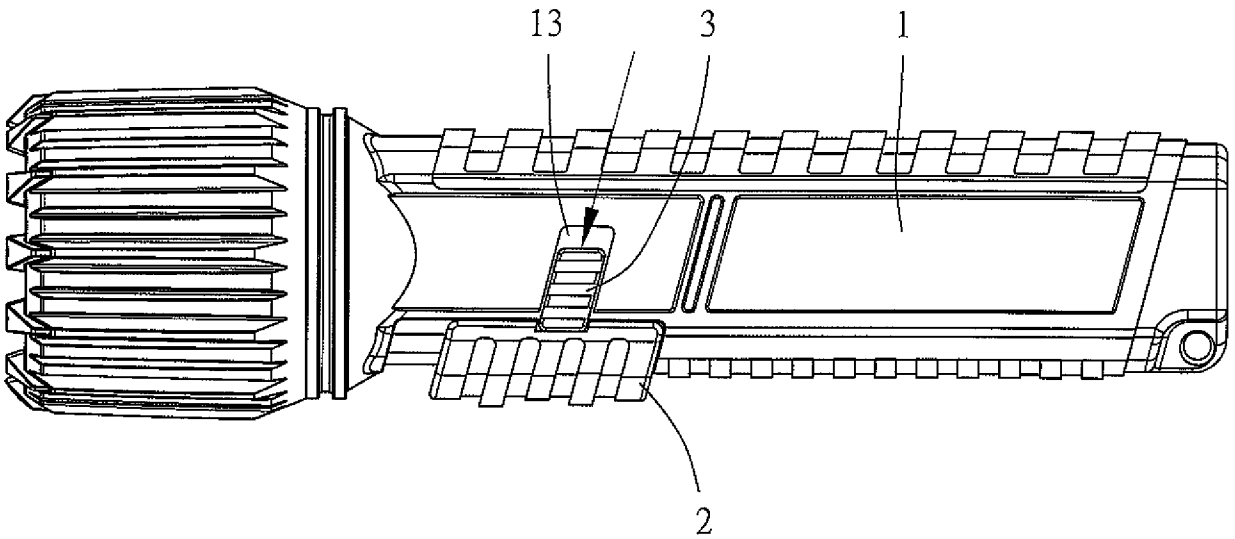
FIG. 11 is a top view showing the flashlight having the safety pin of the present invention at its locking position.

When the flashlight (1) is not in use to provide illumination, the safety pin (3) next to the flashlight (1) can be pushed in the direction indicated by the arrow in FIG. 11. Thus, the bulge (32) inside the safety pin (3) is forced to climb over the retaining portion (15) of the T-shaped base (14) of the flashlight (1) [as shown in FIG. 10], and then engages with the recess (21) of the slide power switch (2) [as shown in FIG. 9], thereby locking the slide power switch (2) and preventing the flashlight (1) from being unintentionally turned on.

What is claimed is:

1. A structure for preventing misoperation of a flashlight being provided at one side of the flashlight and configured to prevent the flashlight from being unintentionally turned on, the structure comprising: a safety pin located at an appropriate position with respect to a slide power switch, with the slide power switch slidably provided at a predetermined section of the flashlight at a periphery of the flashlight for slideable movement in a first direction, with the slide power switch having a first end and a second end spaced from the first end in the first direction, with the slide power switch having a recess for removably receiving the safety pin, with the recess located intermediate the first and second ends, an embrasure-like channel provided at a lower part of the safety pin for matching a T-shaped base in an accommodating area of the flashlight, with the safety pin slideably mounted by the embrasure-like channel and the T-shaped base for slideable movement in a second direction perpendicular to the first direction between an engaged position and a disengaged position, with the T-shaped base having a T-shape perpendicular to the second direction, a retaining portion provided at a front part of the T-shaped base of the flashlight, and a bulge formed inside the channel of the safety pin, with the bulge moveable relative to the retaining portion in the second direction, with the bulge retained in the retaining portion to retain the safety pin in the disengaged position when the structure is not in use, wherein the safety pin is in the engaged position when the safety pin is pushed in the second direction toward the slide power switch and the bulge climbs over the retaining portion, and wherein the safety pin in the engaged position is engaged with the recess of the slide power switch, whereby the flashlight not in use is secured from misoperation, namely being unintentionally turned on.

2. The structure of claim 1, further comprising: a post extending from the flashlight perpendicular to the first direction; and a spring extending in the first direction, wherein the slide power switch slidably provided on the flashlight has an inner surface thereof formed with an accommodating space for receiving the spring, wherein one end of the spring abuts against one side of the post provided on the flashlight, whereby the slide power switch slidably provided on the flashlight is moved forward each time the slide power switch is pushed, and then is restored by a resilience of the spring.

3. The structure of claim 1, wherein the slide power switch slidably provided on the flashlight has an inner surface thereof formed with a pair of retaining portions at two axial edges for engaging with corresponding slots provided on the periphery of the flashlight and extending in the first direction, thereby allowing the slide power switch to slide in the first direction in a predetermined range on the periphery of the flashlight.

4. The structure of claim 1, wherein the slide power switch slidably provided on the flashlight has an inner surface thereof formed with a receiving hole for receiving a magnetic member, wherein when the slide power switch is pushed forward, the magnetic member approaches a reed switch installed on the flashlight to activate the flashlight to illuminate in multiple modes including dimmed lighting, full lighting, flash lighting and light off.

* * * * *